US009102147B2

(12) United States Patent
Yoneta

(10) Patent No.: US 9,102,147 B2
(45) Date of Patent: Aug. 11, 2015

(54) LIQUID DISCHARGE HEAD AND IMAGE FORMING APPARATUS

(71) Applicant: Ryohta Yoneta, Tokyo (JP)

(72) Inventor: Ryohta Yoneta, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/186,106

(22) Filed: Feb. 21, 2014

(65) Prior Publication Data

US 2014/0253648 A1 Sep. 11, 2014

(30) Foreign Application Priority Data

Mar. 7, 2013 (JP) ..... 2013-045957

(51) Int. Cl.

| | |
|---|---|
| ***B41J 2/175*** | (2006.01) |
| ***B41J 2/14*** | (2006.01) |
| ***B41J 2/16*** | (2006.01) |

(52) U.S. Cl.

CPC ..... *B41J 2/14274* (2013.01); *B41J 2/1612* (2013.01); *B41J 2/1623* (2013.01); *B41J 2002/14403* (2013.01); *B41J 2002/14491* (2013.01)

(58) Field of Classification Search

CPC ..... B41J 2/16; B41J 2/045; B41J 2/055; B41J 2/1623; B41J 2/17513

USPC ..... 347/84, 93, 94

See application file for complete search history.

(56) References Cited

U.S. PATENT DOCUMENTS

| | | | | |
|---|---|---|---|---|
| 6,189,214 | B1 * | 2/2001 | Skeath et al. | 29/890.142 |
| 6,352,209 | B1 * | 3/2002 | Skeath et al. | 239/8 |
| 8,070,279 | B2 * | 12/2011 | Miura | 347/93 |
| 8,348,407 | B2 | 1/2013 | Matsufuji et al. | |
| 2004/0179057 | A1 * | 9/2004 | Yamada | 347/20 |
| 2006/0170731 | A1 * | 8/2006 | Ma et al. | 347/44 |
| 2006/0187279 | A1 * | 8/2006 | Childs et al. | 347/85 |
| 2007/0176990 | A1 * | 8/2007 | Urayama et al. | 347/93 |
| 2008/0254228 | A1 * | 10/2008 | Kojima et al. | 427/466 |

FOREIGN PATENT DOCUMENTS

| | | |
|---|---|---|
| JP | 2004-090297 | 3/2004 |
| JP | 2005-238761 | 9/2005 |
| JP | 2007-253439 | 10/2007 |

(Continued)

OTHER PUBLICATIONS

U.S. Appl. No. 14/020,951, filed Sep. 9, 2013.

(Continued)

*Primary Examiner* — Matthew Luu
*Assistant Examiner* — Patrick King
(74) *Attorney, Agent, or Firm* — Cooper & Dunham LLP

(57) ABSTRACT

A liquid discharge head includes nozzles discharging liquid droplets; liquid chambers in communication with the nozzles; liquid supply paths in communication with the individual liquid chambers; and a common liquid chamber in communication with the liquid supply paths. Further, liquid is supplied from a direction from the common liquid chamber to the liquid supply paths, the direction crossing a direction of liquid flowing in the liquid supply paths, and in a wall surface of the common liquid chamber on a side closer to the individual liquid chambers, an inclined surface is formed in a direction orthogonal to a nozzle array direction in a manner that the common liquid chamber gradually expands as the common liquid chamber approaches the liquid supply paths.

7 Claims, 7 Drawing Sheets

(56) References Cited

FOREIGN PATENT DOCUMENTS

| | | |
|---|---|---|
| JP | 2007-320109 | 12/2007 |
| JP | 2011-025663 | 2/2011 |

OTHER PUBLICATIONS

U.S. Appl. No. 13/788,642, filed Mar. 7, 2013.

* cited by examiner

LIQUID DISCHARGE HEAD AND IMAGE FORMING APPARATUS

CROSS-REFERENCE TO RELATED APPLICATIONS

The present application is based on and claims the benefit of priority under 35 U.S. §119 of Japanese Patent Application No. 2013-045957 filed on Mar. 7, 2013, the entire contents of which are hereby incorporated herein by reference.

BACKGROUND OF THE INVENTION

1. Field of the Invention

The present invention relates to a liquid discharge head and an image forming apparatus.

2. Description of the Related Art

As an image forming apparatus such as a printer, a facsimile machine, a copier, a plotter, and a multi-function peripheral, there has been known, for example, an inkjet recording medium that employs a liquid discharge recording method using a recording head including a liquid discharge head (liquid droplet discharge head) discharging liquid droplets.

For example, Japanese Laid-open Patent Publication No. 2011-025663 discloses a liquid discharge head including a plurality of nozzles discharging liquid droplets, a plurality of respective liquid chambers in communication with the nozzles, a plurality of liquid supply paths supplying liquid to the respective liquid chambers, and a common liquid chamber in communication with the liquid supply paths, in which liquid is supplied from the common liquid chamber to the liquid supply paths in the direction orthogonal to the direction parallel to the liquid flow direction in the liquid supply paths, and a filter member is disposed between the common liquid chamber and the liquid supply paths.

SUMMARY OF THE INVENTION

According to an aspect of the present invention, a liquid discharge head includes a plurality of nozzles discharging liquid droplets; a plurality of individual liquid chambers in communication with the nozzles; a plurality of liquid supply paths in communication with the individual liquid chambers; and a common liquid chamber in communication with the liquid supply paths. Further, liquid is supplied from a direction from the common liquid chamber to the liquid supply paths, the direction crossing a direction of liquid flowing in the liquid supply paths. Further, in a wall surface of the common liquid chamber on a side closer to the individual liquid chambers, an inclined surface is formed in a direction orthogonal to a nozzle array direction in a manner that the common liquid chamber gradually expands as the common liquid chamber approaches the liquid supply paths.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

In related technologies of a liquid discharge head, liquid may be supplied from a common liquid chamber to liquid supply paths by substantially bending the liquid flow at a right angle and a filter member is disposed in the liquid flow. In this case, the liquid supply in the refill process cannot be replenished within a desired time period, which may cause a nozzle defect (discharge failure).

The present invention is made in light of at least the above problem, and may reduce the delay of the liquid supply in the refill process.

In the following, embodiments of the present invention are described with reference to the accompanying drawings. First, a liquid discharge head according to a first embodiment is described with reference to FIGS. 1 through 4.

Figure 1:
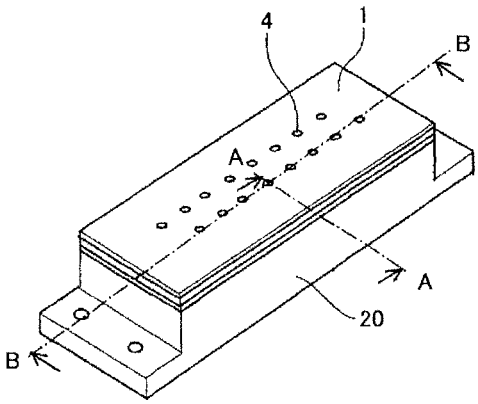
FIG. 1 is a perspective view of an exterior of a liquid discharge head according to an embodiment.
Figure 2:
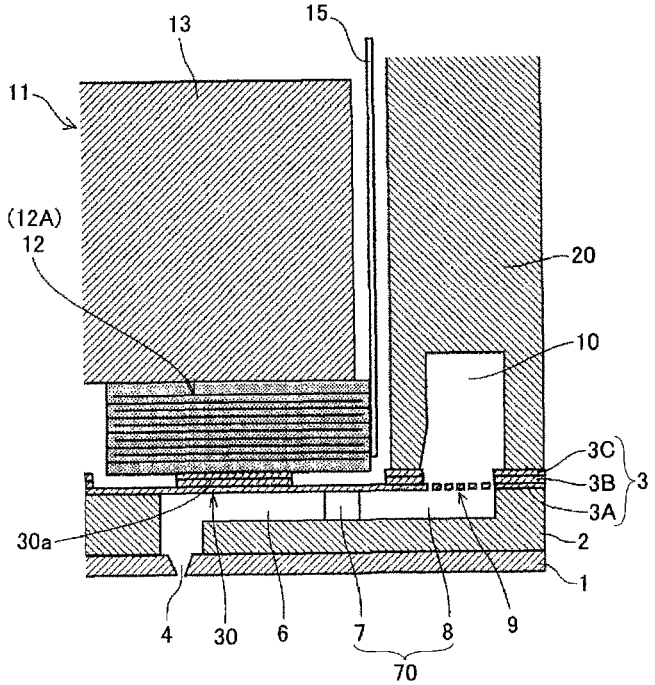
FIG. 2 is a cross-sectional view of the liquid discharge head of FIG. 1 cut along the A-A line of FIG. 1 in the direction (liquid chamber longitudinal direction) orthogonal to the arranged nozzle direction.

FIG. 1 is a perspective view of an exterior of a liquid discharge head according to the first embodiment. FIG. 2 is a cross-sectional view of the liquid discharge head of FIG. 1 cut along the A-A line of FIG. 1 in the direction (liquid chamber longitudinal direction) orthogonal to the arranged nozzle direction.

Figure 3:
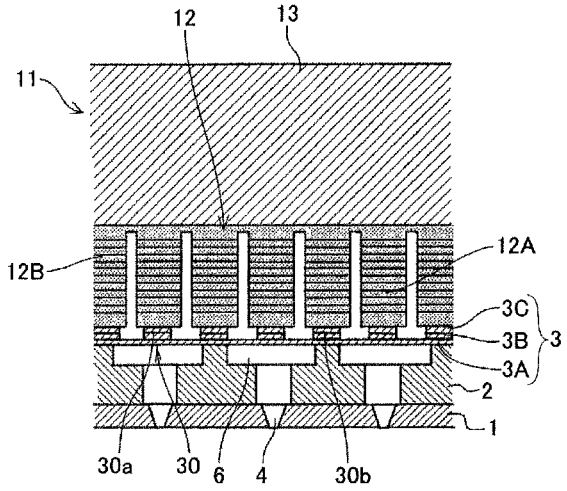
FIG. 3 is a cross-sectional view of the liquid discharge head of FIG. 1 cut along the B-B line of FIG. 1 in the arranged nozzle direction (liquid chamber shorter-side direction)

Herein, the term "liquid chamber longitudinal direction" refers to the longitudinal direction of the individual liquid chambers and does not refer to the longitudinal direction of the common liquid chamber described below. FIG. 3 is a cross-sectional view of the liquid discharge head of FIG. 1 cut along the B-B line of FIG. 1 in the arranged nozzle direction (liquid chamber shorter-side direction).

Figure 4:
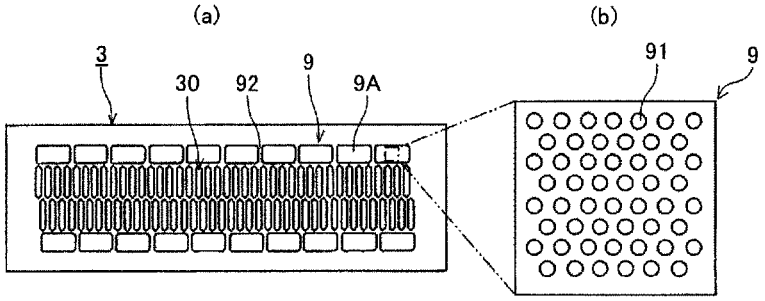
FIG. 4 is a plain view of a vibration plate member and an enlarged view of a part of the vibration plate member.

Herein, the term "liquid chamber shorter-side direction" refers to the direction orthogonal to the "liquid chamber longitudinal direction". FIG. 4 is a plain view of a vibration plate member and an enlarged view of a part of the vibration plate member.

The liquid discharge head includes a nozzle plate 1, a flow path plate (liquid chamber substrate) 2, a vibration plate member 3 as a thin film member, which are laminated and bonded to each other. The liquid discharge head further includes a piezoelectric actuator 11 to displace (vibrate) the vibration plate member 3 and a frame member 20 as a common flew path member.

The nozzle plate 1, the flow path plate 2, and the vibration plate member 3 form an individual liquid chamber 6 which is in communication with a plurality of nozzles 4 discharging liquid droplets, a fluid resistance section 7 which supplies liquid to the individual liquid chamber 6, and a liquid introduction section 8 which is in communication with the fluid resistance section 7. Herein, the liquid introduction section 8 and the fluid resistance section 7 form a liquid supply path 70 to the individual liquid chamber 6.

Further, liquid is supplied from a common liquid chamber 10 as a common flow path of the frame member 20 to a plurality of the individual liquid chambers 6 through a filter section 9 formed in the vibration plate member 3 and via the liquid introduction section 8 and the fluid resistance section 7. In the filter section 9, many filter holes 91 are formed as shown in FIG. 4. Further, in the filter section 9, there are reinforced regions 92 formed, and a plurality of filter regions 9A which are divided, each corresponding to the two or more liquid supply paths 70.

Here, the nozzle plate 1 is formed of a Nickel (Ni) metal plate and is formed by an electroforming method. However, the method of forming the nozzle plate 1 is not limited to this method. For example, the nozzle plate 1 may be formed of another metal member, a resin member, a member where a resin layer and a metal layer are laminated to each other or the like. In the nozzle plate 1, the nozzles 4 having a diameter, for example, in a range of 10 to 35 μm are formed. The nozzle plate 1 is bonded to the flow path plate 2. Further, on a liquid droplet discharge side surface (i.e., a surface in the discharge direction, a discharge surface, or a surface opposite to the surface on the individual liquid chamber 6 side) of the nozzle plate 1, a water repellent layer is formed.

The flow path plate 2 is formed by etching a single-crystal silicon substrate, so that a groove part including the individual liquid chamber 6, the fluid resistance section 7, and the liquid introduction section 8 is formed. The flow path plate 2 may be formed by etching a metal plate such as a SUS substrate with acid etchant, or may be formed by a machine process such as pressing.

The vibration plate member 3 concurrently serves as a wall surface member forming a wall surface of the individual liquid chambers 6 of the flow path plate 2. The vibration plate member 3 has a multi-layer structure including a first layer 3A, a second layer 3B, and a third layer 3C from the individual liquid chambers 6 side. However, the number of the layers may be two or four or more. Further, there is a vibration region 30, which can be deformed, in a part of the first layer 3A, the part corresponding to the individual liquid chamber 6.

Here, the vibration plate member 3 is formed of a Nickel (Ni) metal plate and is formed by an electroforming method. However, the method of forming the vibration plate member 3 is not limited to this method. For example, the vibration plate member 3 may be formed of another metal member, a resin member, a member where a resin layer and metal layer are laminated to each other or the like.

Further, on a side opposite to the individual liquid chamber 6 side relative to the vibration plate member 3, there is disposed the piezoelectric actuator 11 including an electromechanical conversion unit serving as a drive unit (actuator unit, pressure generation unit) to deform the vibration region 30 of the vibration plate member 3.

The piezoelectric actuator 11 includes a plurality of lamination-type piezoelectric members 12 which are bonded to each other on a base member 13. As the lamination-type piezoelectric members 12, there are a predetermined number of included piezoelectric poles (12A, 12B) which are separated from each other by a predetermined distance and are formed in a comb-like shape.

Here, the piezoelectric poles 12A and 12B are basically the same as each other, but differ from each other in that the piezoelectric pole 12A serves as a driving piezoelectric pole (driving pole) to which a driving waveform is applied so as to drive the piezoelectric pole 12A, and the piezoelectric pole 12B serves as a non-driving piezoelectric pole (non-driving pole) and is used as a simple pillar (supporting post).

Further, the driving piezoelectric pole 12A is bonded to a concave convex part 30*a* which is an island-shaped thick part formed on the vibration region 30 of the vibration plate member 3. On the other hand, the non-driving piezoelectric pole 12B is bonded to a convex part 30*b* which is a thick part of the vibration plate member 3 and does not correspond to the vibration region 30 of the vibration plate member 3.

The lamination-type piezoelectric members 12 is formed by alternately laminating a piezoelectric layer and an internal electrode. Further, the internal electrode is connected to an edge surface and an external electrode is provided. Further, there is a flexible printed circuit board (FPC) 15 being flexibility connected to the external electrode of the driving piezoelectric pole 12A to apply a drive signal to the external electrode of the driving piezoelectric pole 12A.

The frame member 20 may be formed by injection forming using, for example, an epoxy-based resin or polyphonylene sulfite, which is a thermoplastic resin, so that the common liquid chamber 10 to which liquid is supplied from a head tank or a liquid cartridge (which are not shown) is formed.

In the liquid discharge head having such a structure described above, for example, by lowering a voltage value applied to the driving piezoelectric pole 12A from a reference potential, the driving piezoelectric pole 12A shrinks and the position of the vibration region 30 of the vibration plate member 3 is higher. As a result, the volume of the individual liquid chamber 6 is expanded, so that liquid is introduced into the individual liquid chamber 6.

After that, the voltage value applied to the driving piezoelectric pole 12A is increased, so that the driving piezoelectric pole 12A expands in the laminated direction thereof and the vibration region 30 of the vibration plate member 3 is deformed in the nozzle 4 direction to shrink the volume of the individual liquid chamber 6. By doing this, the liquid in the individual liquid chamber 6 is pressed, so that liquid droplets are discharged (ejected) from the nozzle 4.

Further, by setting the voltage value applied to the driving piezoelectric pole 12A back to the referential potential, the position of the vibration region 30 of the vibration plate member 3 is returned to its initial position and the volume of the individual liquid chamber 6 expands so as to generate a negative pressure therein. Then, the individual liquid chamber 6 is filled with the liquid which is supplied from the common liquid chamber 10 via the liquid supply path 70. Further, after the vibration of the meniscus surface of the nozzle 4 is attenuated and stabilized, the process repeats to discharge the next liquid droplets.

Here, it is noted that the method of driving the recording head is not limited to the method (i.e., deforming the vibration region 30) described above. For example, a method may be used where a driving waveform is applied in another way for deforming the vibration region 30.

Figure 5:
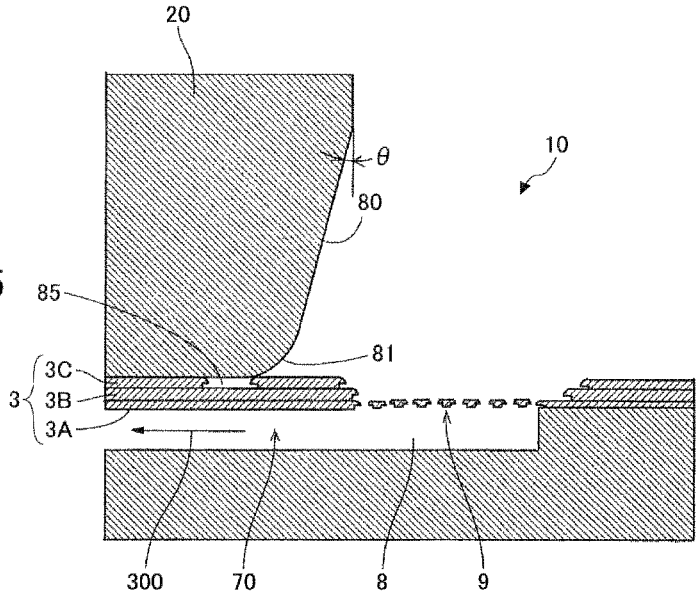
FIG. 5 is an enlarged cross-sectional view of a part of a common liquid chamber and a liquid supply path to illustrate a wall surface structure of the common liquid chamber according to a first embodiment.

Next, a wall surface structure of the common liquid chamber 10 according to the first embodiment is described with reference to FIG. 5. FIG. 5 is an enlarged cross-sectional view of a part of the common liquid chamber and the liquid supply path to illustrate a wall surface structure of the common liquid chamber according to the first embodiment.

First, liquid is supplied from the common liquid chamber 10 to the liquid supply path 70 in the direction crossing the liquid flow direction (i.e., the arrow 300 direction) in the liquid supply path 70. Here, the liquid supply direction from the common liquid chamber 10 to the liquid supply path 70 is the same as the liquid droplet discharge direction (downward direction). Further, the liquid flow direction (the arrow 300 direction) in the liquid supply path 70 is orthogonal to the liquid droplet discharge direction and is also orthogonal to the arranged nozzle direction (see FIG. 1).

According to the first embodiment, the wall surface of the frame member 20 facing the common liquid chamber 10 and on the side closer to the individual liquid chamber 6 in the direction orthogonal to the arranged nozzle direction the liquid chamber longitudinal direction), an inclined surface 80 is formed in a manner that the cross section of the common liquid chamber 10, the cross section being orthogonal to the liquid flow direction in the common liquid chamber 10, gradually expands as the cross section of the common liquid chamber 10 approaches the liquid supply path 70. In the example of FIG. 5, the inclined angle "θ" of the inclined surface 80 relative to the vertical axis is set to approximately 11 degrees.

Figure 6:
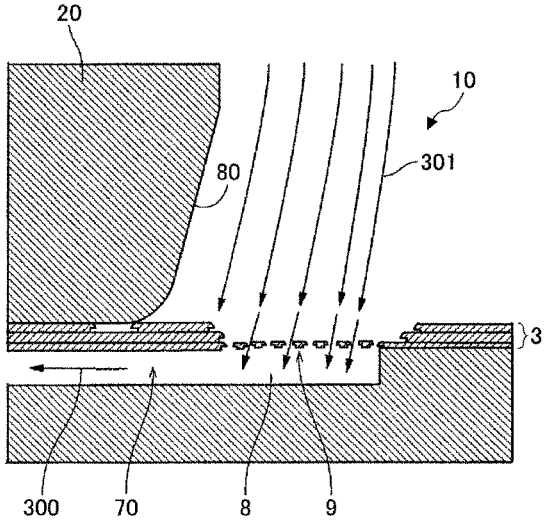
FIG. 6 is an enlarged cross-sectional view to illustrate a function according to the first embodiment.

By forming the frame member 20 as described above, when liquid is supplied from the common liquid chamber 10 to the liquid introduction section 8 in the liquid supply path 70 via the filter section 9, as shown in FIG. 6, a liquid flow 301 along the inclined surface 80 of the common liquid chamber 10 (frame member 20) is generated.

By the generated liquid flow 301 along the inclined surface 80 of the common liquid chamber 10, when liquid is supplied from the common liquid chamber 10 to the liquid introduction section 8, the resistance generated when the flow direction of the liquid introduced into the liquid introduction section 8 is changed into the flow direction of the liquid in the liquid supply path 70 is reduced, so that it becomes possible to more smoothly change the flow direction of liquid.

Figure 7:
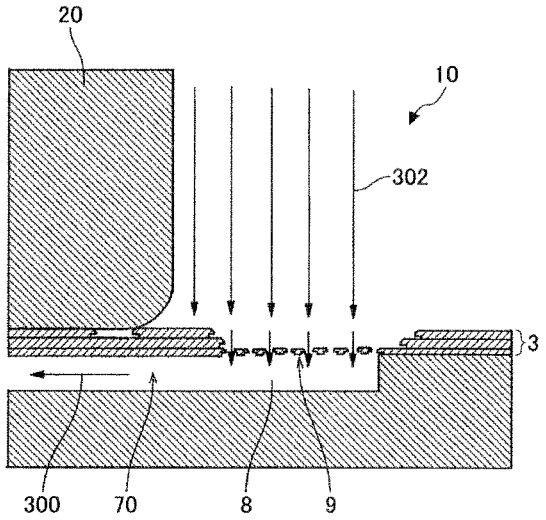
FIG. 7 an enlarged cross-sectional view to illustrate a function according to a comparative example.

Namely, as shown in FIG. 7, in a case where the flow direction 302 of the liquid supplied from the common liquid chamber 10 to the liquid introduction section 8 is changed at a right angle, the resistance becomes larger due to the existence of the filter section 9 and it becomes difficult to smoothly alter the flow direction 302 of liquid into the flow direction of the liquid supply path 70. As a result, it may become difficult to sufficiently supply liquid in the refill process within a desired time period.

On the other hand, when liquid is supplied from the liquid introduction section 8 as described with reference to FIG. 6 according to this embodiment, even if the inclined surface 80 is small, the liquid flows at an inclined angle so that the flow angle of the direction of the liquid supplied into the liquid supply path 70 relative to the flow direction in the liquid supply path 70 is reduced. Therefore, it becomes possible to more smoothly alter the flow direction of the liquid when the liquid is supplied from the common liquid chamber 10 into the liquid supply path 70.

Therefore, according to this embodiment, even when the time interval between the refill processes is reduced due to high-frequency driving, it may become possible to quickly and sufficiently supply liquid from the common liquid chamber 10 into the individual liquid chamber 6. Also, it may become possible to reduce the risk of a nozzle defect state where liquid cannot be sufficiently supplied within a desired time period.

In this case, by partially forming the inclined surface 80 only on the filter section 9 side of the common liquid chamber 10 (frame member 20) (i.e., on the side which is in communication with the liquid supply path 70), it may become possible to prevent the reduction of the volume of the frame member 20 when compared with a case where the inclined surface 90 is formed on the entire wall surface of the frame member 20.

Further, according to this embodiment, as described above, the vibration plate member 3 has a three-layer structure including the first layer 3A, the second layer 3B, and the third layer 3C, and the filter section 9 is formed of the first layer 3A. Further, the third layer 3C, which differs from the first layer 3A forming the filter section 9, is bonded with adhesive to the frame member 20 which is a common liquid chamber member.

Further, in this embodiment, the vibration plate member 3 is formed of a Nickel (Ni) metal plate and is formed to have the multi-layer structure by an electroforming method. Therefore, in the edge parts of the first layer 3A, the second layer 3B, and the third layer 3C, there are formed respective overhang sections.

Further, in this embodiment, the position of the edge part of the third layer 3C in the vicinity of the filter section 9 is separated more from the filter section 9 than the corresponding position of the edge part of the second layer 3B in the liquid chamber longitudinal direction. Due to this, a space "S1" is formed between the overhang section of the third layer 3C and the second layer 3B.

Due to the space "S1", even when the adhesive 86 bonding between the frame member 20 and the vibration plate member 3 flows out to the vicinity of the overhang section of the third layer 3C, the space "S1" may contain the adhesive. As a result, it may become possible to reduce the risk that adhesive flows out to the filter section 9.

Further, according to this embodiment, there is formed a concave part 85 on the bonding surface of the third layer 3C bonding to the frame member 20, so as to hold the adhesive that flows out therein.

Figure 8:
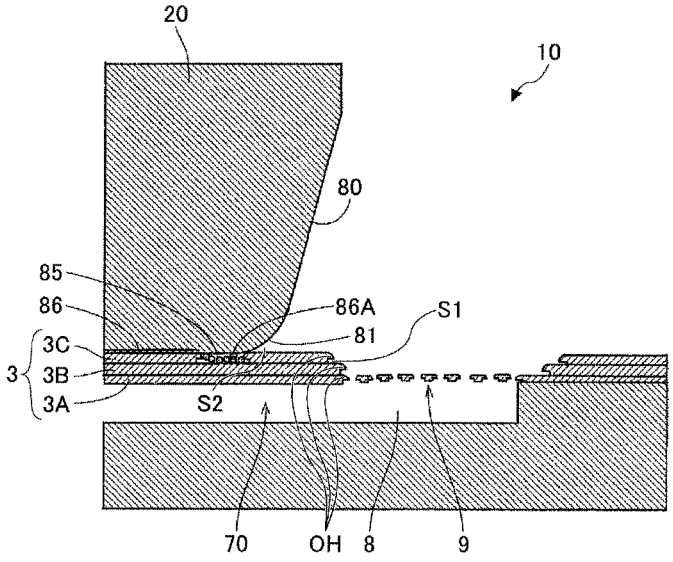
FIG. 8 is another enlarged cross-sectional view to illustrate a function according to the first embodiment.

By having the concave part 85, as shown in FIG. 8, extra adhesive 86A that flows out when the frame member 20 and the vibration plate member 3 are bonded to each other with adhesive may be contained in the concave part 85, so that it may become possible to prevent the extra adhesive 86A from entering the filter section 9 and sealing the filter holes 91.

Further, by forming the concave part 85 to hold the extra adhesive 86A on the vibration plate member 3 side, it may become possible to reduce the protrusion which is generated when the bonding position between the frame member 20 and the vibration plate member 3 is displaced. In other words, if such a concave part is formed on the frame member 20 side, the concave part may be exposed due to the bonding displacement between the frame member 20 and the vibration plate member 3 and the extra adhesive 86A may flow out to the filter section 9.

Further, in this embodiment, a round surface (R surface) 81 is formed on the wall surface of the common liquid chamber 10 (frame member 20) near the edge part in the vicinity of the individual liquid chamber 6 in the direction orthogonal to the arranged nozzle direction (i.e., in the liquid chamber longitudinal direction). By having the R surface 81, it may become possible to prevent the extra adhesive 86A from flowing out to the filter section 9 by a space "S2" which is generated between the R surface 81 of the frame member 20 and the vibration plate member 3 facing the R surface 81 of the frame member 20.

Further, in this embodiment, the inclined surface 80 is formed on the frame member 20 in the vicinity of the concave part 85. In the region of the inclined surface 80, the frame member 20 is formed as a cut-away portion. Therefore, even when the extra adhesive 86A flows out from the concave part 85, the extra adhesive 86A may be contained in the cut-away portion without entering the filter section 9.

Namely, the edge part of the frame member 20 having the cut-away portion close to the filter section 9 according to this embodiment is separated more from the filter section 9 when compared with a case where the edge part of the frame member 20 close to the filter section 9 does not have such a cut-away portion. Due to the difference, it may become possible to reduce the amount of the extra adhesive 86A that flows out to the filter section 9 along the frame member 20.

Figure 9:
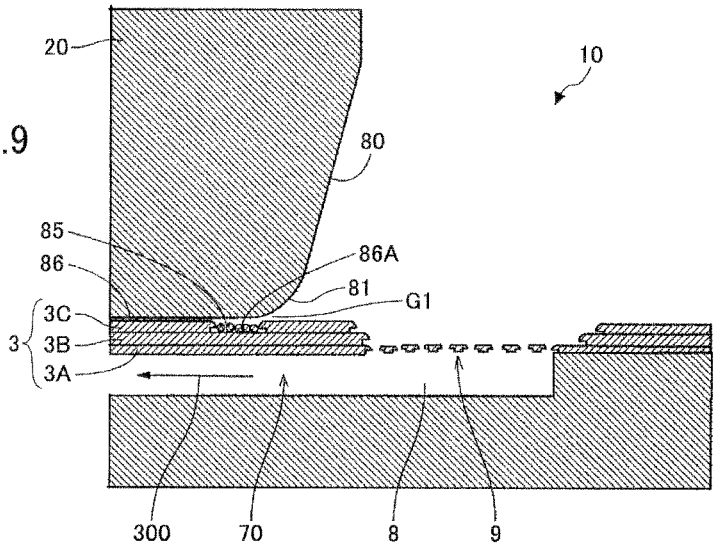
FIG. 9 is an enlarged cross-sectional view of a part of a common liquid chamber and a liquid supply path to illustrate a wall surface structure of the common liquid chamber according to a second embodiment.

Next, a second embodiment is described with reference to FIG. 9. FIG. 9 is an enlarged cross-sectional view of a part of a common liquid chamber and a liquid supply path to illustrate a wall surface structure of the common liquid chamber according to the second embodiment.

The second embodiment differs from the first embodiment in that the frame member 20 and the vibration plate member 3 are bonded to each other in a manner that a part of the concave part 85, which holds the extra adhesive 86A, faces a part of the R surface 81 formed on the frame member 20.

Namely, as shown in FIG. 9, a gap "G1" is formed in a region of the concave part 85 that faces the part of the R surface 81 formed on the frame member 20.

By having the gap "G1", when the frame member 20 and the vibration plate member 1 are bonded to each other with adhesive, air in the concave part 85 is exhausted via the gap "G1". Therefore, the introduction of the extra adhesive 86A into the concave part 85 is not prevented by the air in the concave part 85. As a result, it may become possible to effectively contain (introduce) the extra adhesive 86A in the concave part 85.

Figure 10:
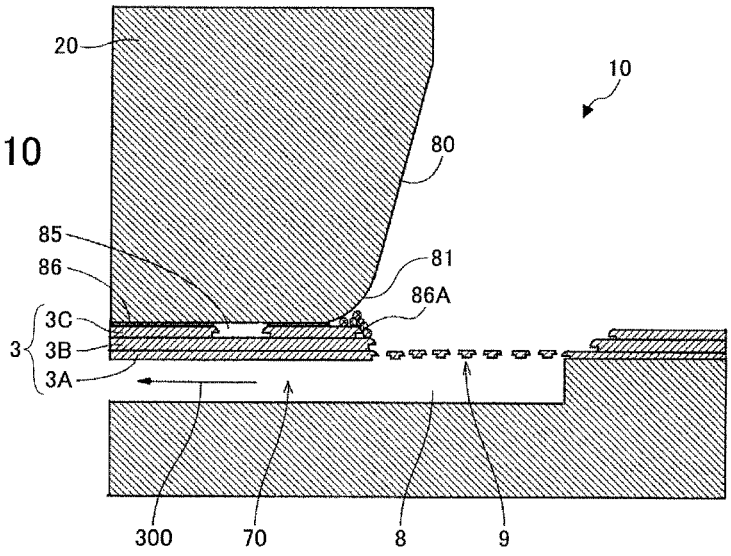
FIG. 10 is an enlarged cross-sectional view of a part of a common liquid chamber and a liquid supply path to illustrate a wall surface structure of the common liquid chamber according to a comparative example.

On the other hand, as shown in FIG. 10, in the comparative example of this embodiment, the R surface 81 formed on the frame member 20 does not face the concave part 85. Therefore, the air in the concave part 85 cannot be exhausted. Therefore, the introduction of the extra adhesive 86A into the concave part 85 is impeded by the air in the concave part 85. As a result, it becomes difficult to effectively introduce the extra adhesive 86A into the concave part 85.

Figure 11:
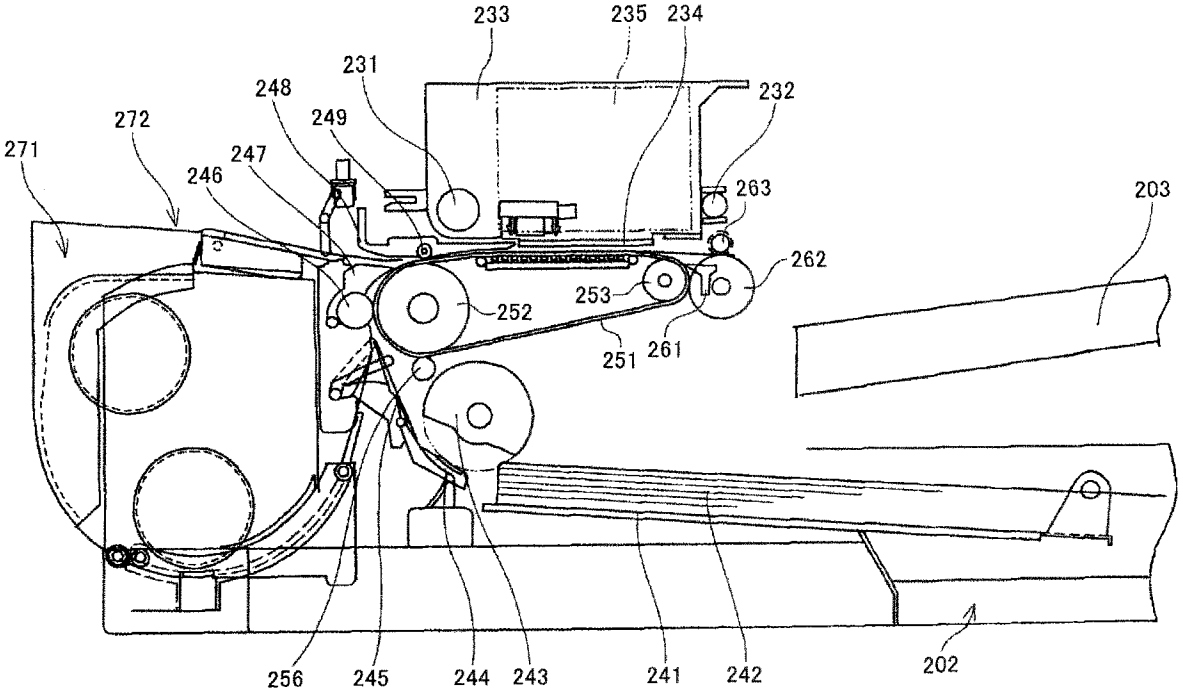
FIG. 11 is a side view of a mechanical part to illustrate an example image forming apparatus according to an embodiment.
Figure 12:
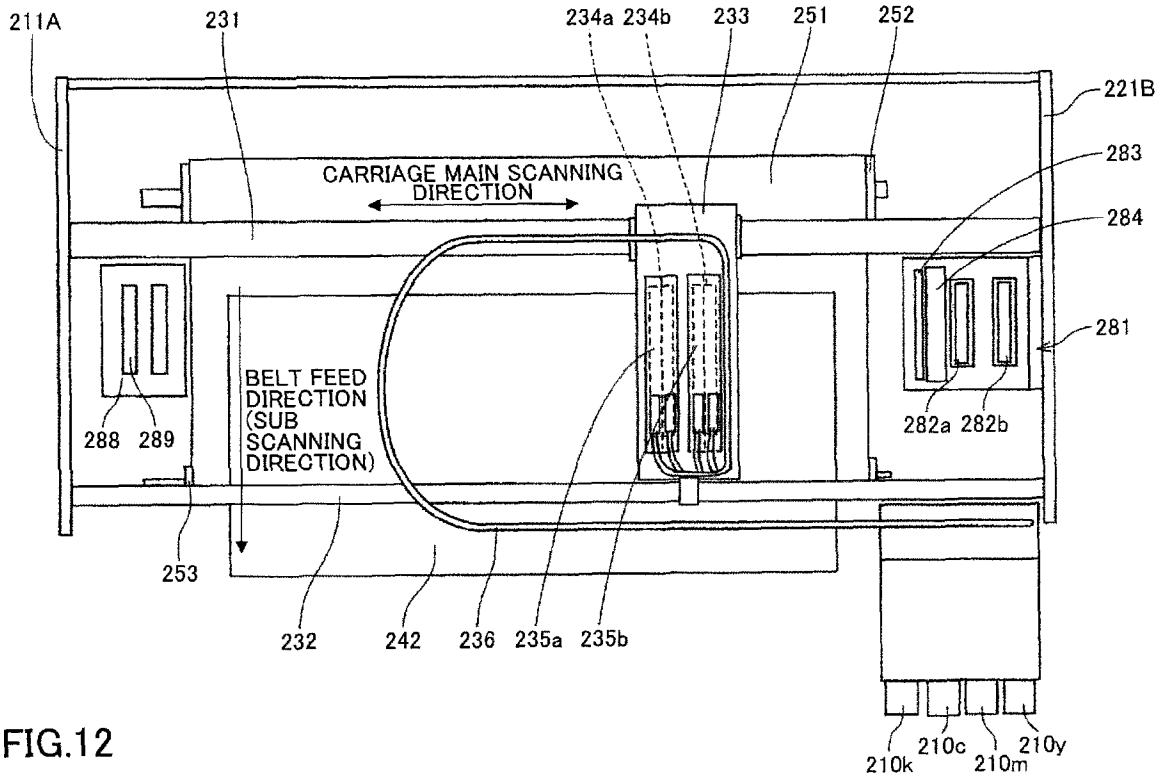
FIG. 12 is a top view of a main part of the mechanical part.

Next, an example of an image forming apparatus including a liquid discharge head according to an embodiment is described with reference to FIGS. 11 and 12. FIG. 11 is a side view of a mechanical part of the example image forming apparatus according to an embodiment. FIG. 12 is a top view of a main part of the mechanical part.

The image forming apparatus is a serial-type image forming apparatus and includes left and right side plates 221A and 221B and main and sub guide rods 231 and 232 which are bridged between the side plates 221A and 221B and hold a carriage 233 so as to slide in the main scanning direction. The carriage 233 is moved and scanned in the arrow direction (carriage main scanning direction) by using a timing belt which is driven by a main scanning motor (not shown).

The carriage 233 includes a recording head 234, which is integrated with a liquid discharge head according to an embodiment and a tank storing ink to be supplied to the recording head 234. The recording head 234 is provided for discharging yellow (Y), cyan (C), magenta (M), and black (K) color ink droplets. The recording head 234 includes a nozzle array having a plurality of nozzles which are arranged in the sub-scanning direction orthogonal to the main-scanning direction, so that ink droplets are discharged downward from the nozzles.

The recording head 234 includes two recording heads 234*a* and 234*b*. Each of the recording heads 234*a* and 234*b* includes two nozzle arrays. The recording head 234*a* includes one nozzle array discharging black (K) liquid droplets and the other nozzle discharging cyan (C) liquid droplets. The recording head 234*b* includes one nozzle array discharging magenta liquid droplets and the other nozzle discharging yellow (Y) liquid droplets. Here, a case is described where two recording heads are provided to discharge four color liquid droplets. However, for example, a single recording head may include four nozzle arrays so that the single recording head discharges each of the four color liquid droplets.

Further, color inks are supplied from the respective ink cartridges 210 to the tank 235 of the recording head 234 via supply tube 236 by a supply unit.

On the other hand, as a sheet supply section to supply sheet 242 stacked on a sheet piling section (pressure plate) 241 of a sheet tray 202, there are a half-moon roller (sheet supply roller) 243 to separate and feed the sheet 242 one by one and a separation pad 244 facing the sheet supply roller 243.

Further, to feed the sheet 242 supplied from the sheet supply section to the position below the recording head 234, there are a guide 245 guiding the sheet 242, a counter roller 246, a feed guide member 247, and a pressing member 248 including a head pressing roller 249. Further, there is a feed belt 251 which serves as a feeding unit to electrostatically adsorb the fed sheet 242 and feed the sheet 242 at the position facing the recording head 234.

The feed belt 251 is an endless belt bridged between a feed roller 252 and a tension roller 253 and rotates belt feed direction (sub-scanning direction). Further, there is a charging roller 256 serving as a charge unit to charge the surface of the feed belt 251. The charging roller 256 is in contact with the surface of the feed belt 251 and is disposed as to be driven to rotate by the rotation of the feed belt 251. The feed belt 251 feeds and rotates in the belt feed direction by being driven by the rotation of the feed roller 252 driven based on the timing of a sub-scanning motor (not shown).

Further, as a sheet discharge section to discharge the sheet 242 on which an image is recorded by the recording head 234, there are a separation claw 261 to separate the sheet 242 from the feed belt 251, a discharge roller 262, and a discharge roll 263. Further, there is a discharge tray 203 under the discharge roller 262.

Further, a double-sided unit 271 is detachably mounted on the rear surface section of the apparatus main body. The double-sided unit 271 takes the sheet 242 returned by the inverse rotation of the feed belt 251, inverts the sheet 242, and feeds the sheet 242 between the counter roller 246 and the feed belt 251 again. Further, the upper surface of the double-sided unit 271 is used as a manual tray 272.

Further, in a non-printing region on one side in the scanning direction of the carriage 233, there is a maintenance and recovery mechanism 281 to maintain and restore the condition of the nozzles in the recording head 234.

The maintenance and recovery mechanism 281 includes cap members 282*a* and 282*b* (hereinafter simplified as a "cap") to cap the nozzle surfaces of the recording head 234. The maintenance and recovery mechanism 281 further includes a wiper blade 283 which is a blade member to wipe the nozzle surfaces. The maintenance and recovery mechanism 281 further includes a preliminary discharge tray 284 to receive liquid droplets discharged in a preliminary discharge process which congealed liquid droplets which do not contribute to recording are discharged.

Further, in a non-printing region on the other side in the scanning direction of the carriage 233, there is a preliminary discharge tray 288 to receive liquid droplets discharged in a preliminary discharge process in which liquid droplets whose viscosity is increased during printing or the like and which do not contribute to printing are discharged. The preliminary discharge tray 238 includes an opening 289 formed in the nozzle array direction of the recording head 234.

In the image forming apparatus having such a configuration described above, the sheets 242 are separated and fed from the sheet tray 202 one by one. The sheets 242 fed upward in the substantially vertical direction are guided by the guide 245 and fed by being sandwiched between the feed belt 251 and the counter roller 246. Further, the head of the sheet 242 is guided by a feed guide 237 and pressed onto the feed belt 251 by the head pressing roller 249, so that the feed direction of the sheet 242 is substantially changed by 90 degrees.

When the sheet 242 is fed on the charged feed belt 251, the sheet 242 is adsorbed to the feed belt 251 to be fed in the sub-scanning direction by the feed and rotation of the feed belt 251.

Then, a line of an image is recorded on the sheet 242, which is stopped, by discharging ink droplets by driving the recording head 234 in accordance with the image signal while the carriage 233 is moved. Then, the sheet 242 is fed a predetermined distance, so that the next line is recorded. When a recording end signal or a signal indicating that the end of the recording sheet 242 reaches the recording region is received, the recording process ends and the sheet 242 is discharged to the discharge tray 203.

As described above, the image forming apparatus includes the liquid discharge head according to an embodiment. Therefore, it may become possible to stably form a high quality image.

In the present application, the material of the "sheet" is not limited to a paper alone. The material of the "sheet" may include, for example, a material of an OHP (Over Head Projector) sheet, fiber (cloth), glass, a substrate or the like to which liquid including ink droplets may be adhered. Further, the "sheet" may be a material called a "medium to be recorded", a "recording medium", a "recording sheet", a "recording paper" and the like. Further, it is assumed that the terms "image formation", "recording", "printing", "print", "image printing" and the like are synonymous words.

Further, the term "image forming apparatus" refers to an apparatus performing image formation by discharging liquid onto a medium including a paper, strings, fibers, cloth, leather, metal, plastic, glass, wood, ceramic or the like. Further, the term "image formation" refers not only to applications of an image having a meaning such as a character, a figure or the like but also to the application of meaningless images to a medium (e.g., simply discharging liquid droplets to a medium).

The term "ink" is not limited to a liquid called "ink" unless otherwise described and is collectively used to represent all the materials that are called "recording liquid", "fixing treatment liquid", "liquid" and the like and that are used for image formation. Therefore, the term "ink" may include a "DNA sample", "resist", "pattern material", "resin" and the like.

Further, the "image" is not limited to a planate object but includes an image applied on a medium and the like which are three-dimensionally formed, and an image formed by three-dimensionally molding a solid object.

Further, unless otherwise described, the term "image forming apparatus" includes a serial-type image forming apparatus and a line-type image forming apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A liquid discharge head comprising:

a plurality of nozzles disposed on a nozzle surface to discharge liquid droplets;

a plurality of individual liquid chambers in communication with the nozzles;

a plurality of liquid supply paths in communication with the individual liquid chambers;

a common liquid chamber member forming a common liquid chamber in communication with the liquid supply paths; and a filter unit including openings, disposed in the liquid supply paths between the individual liquid chambers and the common liquid chamber, wherein liquid is supplied from a direction from the common liquid chamber to the liquid supply paths, the direction crossing a liquid flow direction of liquid flowing in the liquid supply paths, and wherein in a wall surface of the common liquid chamber member facing the common liquid chamber on a side closer to the individual liquid chambers in a direction that is orthogonal to a nozzle array direction, an inclined surface forming an oblique angle relative to the nozzle surface is formed in a manner that a width of the common liquid chamber in the direction that is orthogonal to a nozzle array direction and parallel to the liquid flow direction in the liquid supply paths gradually expands toward the liquid supply paths, wherein the openings of the filter unit are disposed, in a direction that is parallel to a droplet discharge direction and orthogonal to the nozzle array direction, between the nozzles and the inclined surface of the common liquid chamber member.

2. The liquid discharge head according to claim 1, wherein the inclined surface is formed in a part on a side in communication with the liquid supply paths.

3. The liquid discharge head according to claim 1, further comprising:

a filter unit disposed between the common liquid chamber and the liquid supply paths to filter liquid.

4. The liquid discharge head according to claim 3, wherein a filter member including the filter unit is bonded to the common liquid chamber member forming the common liquid chamber, and wherein the filter member further includes a concave part, which is formed in a bonding surface bonding to the common liquid chamber member, to hold adhesive therein.

5. The liquid discharge head according to claim 4, wherein the filter member has a multi-layer structure, wherein a layer different from a layer forming the filter unit is bonded to the common liquid chamber member, and wherein the concave part is formed in a bonding surface of the layer bonded to the common liquid chamber member.

6. The liquid discharge head according to claim 4, wherein a R-shaped surface is formed in an edge part of the wall surface of the common liquid chamber member on the side closer to the individual liquid chambers in the direction orthogonal to the nozzle array direction, and wherein the concave part faces a part of the R-shaped surface.

7. An image forming apparatus comprising:

the liquid discharge head according to claim 1.

* * * * *